United States Patent [19]

Lees

[11] Patent Number: 4,775,155

[45] Date of Patent: Oct. 4, 1988

[54] METHOD AND APPARATUS FOR PLAYING A BINGO LINE GAME

[75] Inventor: Cynthia A. Lees, Parma, Ohio

[73] Assignee: Arrow International, Inc., Cleveland, Ohio

[21] Appl. No.: 24,353

[22] Filed: Mar. 10, 1987

[51] Int. Cl.[4] ..... A63F 3/06

[52] U.S. Cl. ..... 273/139

[58] Field of Search ..... 273/269, 138 R, 138 A, 273/139

[56] References Cited

U.S. PATENT DOCUMENTS

| | | | |
|---|---|---|---|
| D. 132,993 | 7/1942 | Lowe . | |
| 1,655,380 | 1/1928 | Parker | 273/269 |
| 4,084,823 | 4/1978 | Haggedal | 273/269 |
| 4,165,878 | 8/1979 | Frain | 273/240 |
| 4,212,468 | 7/1980 | Knott | 273/240 |
| 4,218,063 | 8/1980 | Cooper et al. | 273/237 |
| 4,252,322 | 2/1981 | Orter | 273/269 |
| 4,312,511 | 1/1982 | Julien | 273/237 |
| 4,332,389 | 6/1982 | Loyd et al. | 273/237 |
| 4,378,940 | 4/1983 | Gluz et al. | 273/237 |
| 4,398,708 | 8/1983 | Goldman et al. | 273/139 |
| 4,475,157 | 10/1984 | Bolan | 364/410 |

OTHER PUBLICATIONS

Publication titled: "Illegal Bingo Line Games", By New York State Racing and Wagering Board.

*Primary Examiner*—Anton O. Oechsle

*Attorney, Agent, or Firm*—Fay, Sharpe, Beall, Fagan, Minnich & McKee

[57] ABSTRACT

A method for playing a side game in connection with a bingo game includes providing a flash board displaying a plurality of numbers in mutually perpendicular rows and columns. A plurality of tickets having a first face and a second face are provided. A column of numbers that is displayed on the second face of each ticket is identical with one of the columns of numbers shown on the flash board. A covering preferably initially masks the column of numbers from view. The plurality of tickets are distributed to players. Numbers are then serially selected from the plurality of numbers and a display is made on the flash board for each number selected. A winner is declared when all the numbers in a vertical row have been chosen.

15 Claims, 2 Drawing Sheets

FIG. 1

10 14 16 B

| B | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

12

22 C

| B | I | N | G | O |
|---|---|---|---|---|
| 1 12 | 6 28 | 11 39 | 16 59 | 21 70 |
| 2 8 | 7 19 | 12 45 | 17 48 | 22 65 |
| 3 7 | 8 18 | FREE | 18 55 | 23 74 |
| 4 2 | 9 24 | 14 35 | 19 60 | 24 67 |
| 5 11 | 10 27 | 15 34 | 20 51 | 25 61 |

24 26 28 20

FIG. 2

40 A 42

44 46

4 WINNERS ON BLUE AT $ 10

4 WINNERS ON YELLOW AT $ 5

2 WINNERS ON RED AT $ 50 48

50 52

6 WINNERS ON GRAY AT $ 2

28 WINNERS ON GREEN AT $ 1

54

593580

FIG. 3
| B | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |
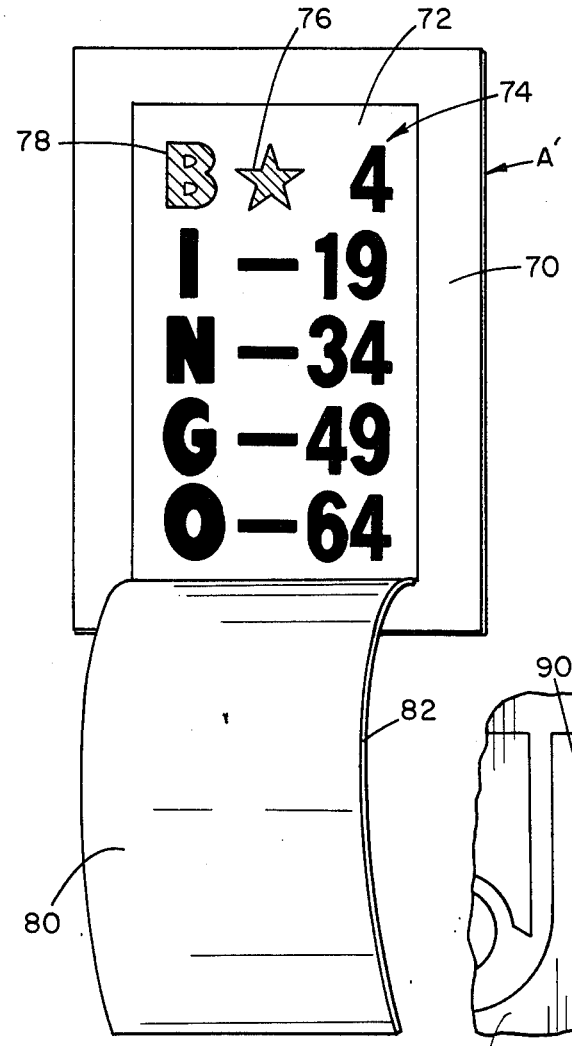
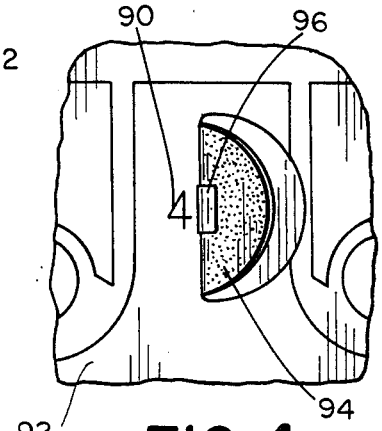
FIG. 4

METHOD AND APPARATUS FOR PLAYING A BINGO LINE GAME

BACKGROUND OF THE INVENTION

This invention generally pertains to the game of bingo. More specifically, the present invention relates to a side game which can be played in connection with a regular bingo game.

The invention is particularly applicable to a playing card and a method for playing a line game in connection with a regular bingo game. However, it will be appreciated by those skilled in the art, that the invention has broader applications and may also be adapted for use in many other types of ancillary games to a normal bingo game or other games such as Lotto, or the like.

Auxillary games played alongside of a normal bingo game are known. One such game is based on the configuration of a bingo "flash" board, which has lighted numbers that indicate the bingo balls that have been previously picked. As is well known, in a bingo flash board the numbers 1–15 are positioned in a first row associated with the letter "B", the numbers 16–30 are positioned in a second row and asociated with the letter "I", and so on, up to the numbers 61–75, which are associated with the letter "O". Also, the numbers 1, 16, 31, 46, and 61 are located in a first column adjacent the word "BINGO" with the numbers 2, 17, 32, 47, and 62 being located in a second column adjacent the first column, and so on for 15 columns. Thus, a grid of five rows (of fifteen numbers each) and fifteen columns (of five numbers each) is provided for the flash board. The grid accommodates the numbers 1–75. In the known game, which is called a bingo line game, the player whose particular vertical line is first illuminated on the bingo flash board would be the winner.

Although such a game is known, it has been played only as an unofficial side game either through a bookmaker or through a group of players acting as their own bookmakers. In both instances, the players would merely pick one of the numbers 1 to 15. The winning player would be the one who had chosen the first number in the completely illuminated column. No such officially recognized bingo line games have yet been played and there is no token available for playing such a game.

Accordingly, it has been considered desirable to develop a new and improved token for playing such a bingo line game as well as methods for playing such a game which would overcome the foregoing difficulties and others while providing better and more advantageous overall results.

BRIEF SUMMARY OF THE INVENTION

In accordance with the present invention, a new and improved method for playing a side game in connection with a bingo game is provided.

More particularly, in accordance with the invention, a flash board is provided for displaying a plurality of numbers in mutually perpendicular rows and columns. A plurality of tickets are provided which each display individual columns of the numbers displayed on the flash board. The plurality of tickets are distributed to players. Bingo numbers are then serially selected causing a display to be made on the flash board for each number so selected. A winner is declared when all the numbers in a column are chosen.

In accordance with another aspect of the invention, a card is provided for playing a bingo-type game.

More specifically, in accordance with this aspect of the invention, the card comprises a first face, and a second face displaying a column of numbers which is identical with one of the columns of numbers shown on an associated flash board. A cover means is provided on the second face for initially obscuring the column of numbers.

Preferably, the card first face includes at least one coded area which provides payout information concerning the card. In one preferred embodiment, the coded area comprises a plurality of spaced color coded boxes. A coding means, such as a colored indicium or the like corresponding to the color of one of the plurality of color coded boxes, is preferably positioned on the second face of the card adjacent the column of numbers. The covering means can initially obscure both the column of numbers and the coding means.

According to yet another aspect of the invention, a method is provided for playing an instant bingo-like number game.

In accordance with this aspect of the invention, a plurality of tickets are provided which each display one column of the numbers displayed on a bingo flash board. The ticket column of numbers is obscured by a cover means. A winning number is selected from the numbers 1–15 which constitute the first line of numbers on the flash board. The plurality of tickets are distributed to players. The cover means is removed after the step of distributing. A winner is declared when a first number in the ticket column of numbers matches the pre-selected winning number.

One advantage of the present invention is the provision of a new and improved game playing card.

Another advantage of the invention is the provision of a bingo line game playing card which displays one column of the numbers shown on a bingo flash board.

Still another advantage of the invention is the provision of a playing card in which a column of numbers is coded, such as by color coding or by a coding indicium. The remuneration of the winner is dependent upon the coding of the column of numbers with different remuneration being provided for the different coding symbols.

A further advantage of the invention is the provision of a covering means for initially covering the column of numbers and the coding symbol until the card is bought and the player removes the covering means.

Yet another advantage of the invention is the provision of a new method for playing a side game in connection with a conventional bingo game or the like.

An additional advantage of the invention is the provision of a new method for playing an instant bingo-like game.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 1 is a schematic view of a bingo flash board and a bingo card;

FIG. 2 is a top plan view of a first face of a game card according to the present invention; and, FIG. 3 is a schematic view of a bingo flash board and a top plan view of a second side of the game card of FIG. 2 with a tear open covering strip shown in the torn open position.

FIG. 4 is a partial view of another embodiment of the invention in which the winning number is posted on a sheet.

DETAILED DESCRIPTION OF THE PREFERRED EMBODIMENT

Referring now to the drawings wherein the showings are for purposes of illustrating a preferred embodiment of the invention only and not for purposes of limiting same, FIGS. 2 and 3 show the subject new playing card A. While the playing card is primarily designed for and will hereinafter be described in connection with a bingo line-type game, it will be appreciated that the overall inventive cocept involved could be adapted for other game environments as well.

FIG. 1 shows a conventional bingo display board or flash board B which is provided with a plurality of vertical columns 10 and horizontal rows 12. As is conventional, sixteen vertical columns are provided with the first column containing the letters B-I-N-G-O and the other columns each containing a series of five numbers that are headed, respectively, by one of the numbers 1–15. Numbers 1–75 are conventionally used in the bingo game with the numbers being divided in five horizontal rows, such that the first row next to the letter "B" ranges from 1–15, the second row next to the letter "I" ranges from 16–30 and so on. The columns and rows divide the display board B into a plurality of squares 14 each of which contains an alphanumeric character or indicium 16.

Conventionally, a bingo card or ticket C, which is used in conjunction with the display board B, includes a card body 20 having thereon a plurality of vertical columnns 22 and horizontal rows 24 which divide the card into squares or boxes 26 each of which displays an alphanumeric indicium 28.

With reference now again to FIG. 2, the present invention comprises the new game card A having a card body 40 with a front face 42. Provided on the front face is a pay-out coding means in the form of a plurality of coded boxes 44, 46, 48, 50, and 52, which can be positioned on the card front face in any desired arrangement. In the embodiment illustrated, the coded boxes are color coded. It should be recognized, however, that numerous types of coding means other than the color coded boxes illustrated could be utilized as desired.

Preferably, a serial number 54 is also provided on the card to indicate to the distributor the precise lot to which the card belongs. In one preferred embodiment, 660 cards are provided in one complete package and the same serial number is assigned to each card in the package.

The front of the card may also include information concerning the price of the card as well as a trademark or the like. For convenience and clarity, neither of these is displayed on the card of FIG. 2.

With reference now also to FIG. 3, a bingo display board and a game card in use are therein illustrated. In order to avoid confusion, the display board and game card will have like components identified by like numerals with a primed (') suffix and new components will be identified by new numerals.

The display Board B' has a plurality of vertical columns 10' and horizontal rows 12' which define squares 14' containing alphanumeric indicia 16'. Some of the squares 14' are illuminated and this is shown by having the numeral in question circled. As the numbers are selected by any conventional process, i.e., such as by having bingo balls picked from a bingo blower, the numbers selected are illuminated on the bingo display board so that players can ascertain what the selected numbers are. Once an entire column 62 is illuminated, by having each number therein picked, a winner is simultaneously chosen, assuming that the playing card displaying that column has been sold prior to the game.

With reference again to the card A', a back face 70 thereof is provided with a display surface 72 which has printed thereon a column of numbers 74. Adjacent the column of numbers is an indicium 76 which has a color identical with one of the colored boxes shown on the front face 42 of the card. If desired, a column of letters 78 spelling out the word BINGO, or another suitable word, may be provided adjacent the column of numbers. As shown, the first letter of the word BINGO can also be colored with the same color as the indicium 76. It is evident that only one colored indicium need be provided for the card. It is thus conceivable to show the color by coloring the column of numbers 74 or the background thereof if desired instead of providing a separate colored indicium.

Preferably, a cover means 80 covers the display surface 72 before the card is bought. The cover means 80 can be a tear-open cover strip. The strip can be held in place by a securing means 82 until the player detaches the cover strip. The securing means can be tear-off ribs or portions between the cover strip 80 and the card back face 70 or an adhesive layer between the cover strip and the back face. Alternatively, the cover means 80 could be a tear-away cover strip, a rub-away coating, or the like.

In play, before a particular bingo game is begun, a plurality of the playing cards A' would be sold to various bingo game players so that the line game could be played simultaneously with a conventional bingo game. As mentioned, the line game is based on the configuration of the bingo flash board and once a particular column of the flash board is completely illuminated, a winner can be declared. The remuneration of the winner will depend upon the colored indicium 76 or other indicating means which is provided adjacent the column of numbers. This indicium, has a color that matches the color of one of the boxes on the front face 42 of the card body, thereby indicating payout information for the particular game sequence.

To control the odds of winning and the pay outs, the seller of the playing cards would insure that all the players receive a playing card with the same serial number. Additionally, for the purposes of payout, the seller would likely refuse to recognize a winning playing card that would have a different serial number from the one that had been distributed for that game. Although it was previously mentioned that 660 cards are preferably provided in one complete package, it is evident that any other member of cards could constitute a package. The size of the package could be varied as dependent on the size of the game, i.e. the number of purchasers, that are anticipated for any particular game. It would also be feasible, of course, to run a game in which two or more complete sets of playing cards, i.e. two serial numbers would be sold and recognized.

Such line games can be operated during "special" or "jackpot" bingo games as well as during a full card bingo game. Generally, a majority of the numbers on the bingo flash board will need to be called, in order to declare a winner. Variations of the five number game, which may be used during shorter or special games, can also be provided in which a player would win when only three or four of the numbers in a particular column are lit on the flash board.

Another game can also be played with the card or ticket of the present invention. In this game, a winning number, which can, for example, be one of the numbers 1–15 that constitute the first row of numbers on the bingo flash board is preselected prior to distribution of the tickets. Subsequently, the tickets are distributed, i.e. sold to the players, with the column of numbers printed on the second face of the ticket being masked. When each player uncovers the column of numbers, he or she can instantly ascertain whether the first number listed in the column of numbers on his ticket is the winning number.

In this connection, and with reference now to FIG. 4, the winning number 90 can generally be posted on a sheet 92 that is displayed adjacent the place where the bingo game is played or where the tickets are sold. The numeral 90 may, initially, be covered by a detachable covering means 94 which can be in the form of a peel-off piece of foil. Preferably, the foil is provided with a thickened area 96 to prevent the number 90 from being at all detectable through the foil. If desired, the sheet 92 can be a cardboard sheet which promotes the instant bingo game and provides the odds of winning various sums of money if the correct number is chosen or if the correct line is chosen. The covering means 94 can be removed before other distribution of the tickets if desired or only after the tickets are distributed.

It should, however, be recognized that the instant winning numeral could be provided at the beginning of the bingo game such as by activating the bingo blower and allowing it to eject balls until one of the balls numbered 1–15 is ejected with that ball then representing the winning number. Alternatively, a ball can be chosen manually from the bingo balls in order to select the winning one.

It should be noted that the above-described instant game can be played in addition to "special," "jackpot" or full card bingo games. Although the same card cannot be utilized for the instant game and then also for the bingo line game in conjunction with one of the above-mentioned bingo games, two separate sets of the same style card can be so used.

The subject invention thus provides a game card for bingo line games and the like as well as two different ways for utilizing such a card to play a game. The game card invention, is however, also adapted for use in various other types of games with which such a card would be desirable.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

What is claimed is:

1. A method for playing a side game in connection with a bingo game, comprising:

providing a flash board displaying a plurality of numbers in mutually perpendicular rows and columns;

providing a plurality of tickets which each display an individual column of the numbers displayed on said flash board;

providing a coding means for said ticket column of numbers;

distributing said plurality of tickets to players wherein in said step of distributing, differing numbers of tickets displaying said column of numbers are distributed depending on the coding means for said column of numbers;

serially selecting numbers and causing a display to be made on said flash board for each number selected; and, declaring a winner when all the numbers in a column are chosen, wherein the remuneration of the winner after said step of declaring a winner is dependent upon the coding means coded on said ticket column of numbers.

2. The method of claim 1 further comprising the step of masking said ticket column of numbers display until after said step of distributing.

3. A card for playing a bingo-type game, comprising:

a first face;

a second face displaying a column of numbers which is identical with one of the columns of numbers shown on an associated flash board;

at least one coded area located on said card first face which provides payout information concerning the card;

a coding means for providing specific payout information concerning the card, said coding means being located on said card second face; and, a cover means for initially obscuring said column of numbers, wherein said cover means also covers said coding means.

4. The card of claim 3 wherein said coding means is a color coded indicium which matches the color of the at least one coded area located on said card first face.

5. A card for playing an auxilliary game while a regular bingo game is being played, the card comprising:

a first face having a plurality of spaced color coded boxes which provide payout information;

a second face displaying a column of numbers which is identical with one of the columns of numbers shown on an associated bingo flash board;

a color coding means corresponding to the color of one of said plurality of color coded boxes, said color coding means being positioned on said second face, adjacent said column of numbers; and, covering means for initially obscuring said column of numbers and said color coding means until said covering means is removed.

6. The card of claim 5 further comprising a serial number provided on said first face.

7. The card of claim 5 wherein said covering means is a tear-open strip.

8. A method for playing a bingo-like game, comprising:

providing a flash board which displays a plurality of numbers in mutually perpendicular rows and columns;

providing a plurality of tickets which each display one column of the numbers displayed on said flash board;

color coding said ticket column of numbers;

distributing said plurality of tickets to players;

selecting a number;

causing a display to be made on said flash board for the number selected;

repeating said step of selecting and causing until all the numbers in a column are selected; and, subsequently declaring a winner, wherein the remuneration of the winner is dependent on the color coded on said ticket column of numbers.

9. The method of claim 8 further comprising the step of providing cover means for masking said ticket column of numbers before said step of distributing.

10. The method of claim 9 further comprising the step of removing said cover means after said step of distributing.

11. The method of claim 8 wherein during said step of distributing, varying numbers of color coded tickets displaying each column are distributed depending on the color coding thereof.

12. A method for playing a bingo-like game comprising:

providing a plurality of tickets which each display one column of the numbers displayed on a bingo flash board;

providing a coding means for said column of numbers;

masking said ticket column of numbers with a cover means;

selecting a winning number from the numbers which constitute one of the rows of numbers on the flash board;

distributing said plurality of tickets to players, wherein differing numbers of tickets displaying said column of numbers are distributed depending on the coding means for said column of numbers;

removing said cover means after said step of distributing; and, declaring a winner when a number in said ticket column of numbers matches the pre-selected winning number.

13. The method of claim 1 wherein said step of providing a coding means for said ticket column of numbers comprises the step of color coding said ticket column of numbers.

14. The method of claim 12 wherein the remuneration of the winner after said step of declaring a winner is dependent upon the coding means coded on said ticket column of numbers.

15. The method of claim 12 wherein said step of providing a coding means for said ticket column of numbers comprises the step of color coding said ticket column of numbers.

* * * * *